US012661558B2

(12) United States Patent
Hainje

(10) Patent No.: US 12,661,558 B2
(45) Date of Patent: Jun. 23, 2026

(54) EXTENDABLE BASEBALL CARRIER

(71) Applicant: Grandstand LLC, Battle Ground, IN (US)

(72) Inventor: Rod Hainje, Battle Ground, IN (US)

(73) Assignee: Grandstand LLC, Battle Ground, IN (US)

( * ) Notice: Subject to any disclaimer, the term of this patent is extended or adjusted under 35 U.S.C. 154(b) by 472 days.

(21) Appl. No.: 18/149,698

(22) Filed: Jan. 4, 2023

(65) Prior Publication Data

US 2024/0216763 A1 Jul. 4, 2024

(51) Int. Cl.

| | |
|---|---|
| ***A63B 47/00*** | (2006.01) |
| *A63B 71/00* | (2006.01) |
| *A63B 102/18* | (2015.01) |

(52) U.S. Cl.

CPC ..... *A63B 47/002* (2013.01); *A63B 2102/18* (2015.10); *A63B 2210/58* (2013.01); *A63B 2225/093* (2013.01)

(58) Field of Classification Search

CPC ..... A63B 2102/18; A63B 2210/58; A63B 2225/093; A63B 47/00; A63B 47/002;
(Continued)

(56) References Cited

U.S. PATENT DOCUMENTS 1,344,716 A * 6/1920 Powell ..... A24F 23/02 206/256
2,296,215 A * 9/1942 Layher ..... B65D 83/761 220/536

(Continued)

FOREIGN PATENT DOCUMENTS

DE 19948940 A1 * 4/2000 ..... B65D 83/766
GB 2569192 A * 6/2019 ..... A47F 3/06

*Primary Examiner* — Anthony D Stashick
*Assistant Examiner* — Marcos Javier Rodriguez Molina
(74) *Attorney, Agent, or Firm* — Brannon Sowers & Cracraft PC; David E. Novak

(57) ABSTRACT

A ball carrying assembly, including a first right circular cylindrical portion, a first disc portion disposed at one end of the first right circular cylindrical portion and fixed thereto to define a canister, a second right circular cylindrical portion defining a storage volume and disposable within the first right circular cylindrical portion and operationally connected thereto, a platform portion movably disposed within the second right circular cylindrical portion, three equidistantly spaced ledge portions formed within the first right circular cylindrical portion, and three equidistantly spaced tab portions protruding from the second right circular cylindrical portion. Each respective tab portion is lockingly engageable with a respective ledge portion. A spring assembly is operationally connected within the storage volume to the movable platform portion. The spring assembly has a spring constant sufficient to urge the movable platform portion away from the pull of gravity when balls are removed from the storage volume. Second right circular cylindrical portion also includes spaced ridges positioned on outside and inside thereof and extending parallel with the cylindrical axis and defining ventilation volume therebetween for ease of movement of platform portion therein and of cylindrical portions relative to one another.

14 Claims, 7 Drawing Sheets

(58) Field of Classification Search

CPC ..... A63B 71/0045; A63B 2024/0025; A63B 2024/0034; A63B 2024/0037; A63B 2024/0056; A63B 2047/004; A63B 2053/0491; A63B 2063/001; A63B 2069/0008; A63B 2069/185; A63B 2071/025; A63B 2071/0602; A63B 2071/0625; A63B 2071/063; A63B 2071/0638; A63B 2071/0694; A63B 2071/125; A63B 21/0055; A63B 21/072; A63B 21/0724; A63B 21/0726; A63B 21/4035; A63B 2102/02; A63B 2102/14; A63B 2102/32; A63B 2208/12; A63B 2209/00; A63B 2209/02; A63B 2209/08; A63B 2209/10; A63B 2210/50; A63B 2220/05; A63B 2220/10; A63B 2220/12; A63B 2220/13; A63B 2220/16; A63B 2220/17; A63B 2220/18; A63B 2220/20; A63B 2220/24; A63B 2220/30; A63B 2220/40; A63B 2220/44; A63B 2220/50; A63B 2220/51; A63B 2220/53; A63B 2220/56; A63B 2220/62; A63B 2220/72; A63B 2220/74; A63B 2220/75; A63B 2220/76; A63B 2220/80; A63B 2220/801; A63B 2220/803; A63B 2220/805; A63B 2220/806; A63B 2220/807; A63B 2220/808; A63B 2220/833; A63B 2220/836; A63B 2220/89; A63B 2225/09; A63B 2225/15; A63B 2225/20; A63B 2225/30; A63B 2225/50; A63B 2225/54; A63B 2225/64; A63B 2225/74; A63B 2230/01; A63B 2230/06; A63B 2230/50; A63B 2230/60; A63B 2243/0025; A63B 2243/0037; A63B 2243/0054; A63B 2243/0066; A63B 2243/007; A63B 2243/0095; A63B 2244/19; A63B 2244/20; A63B 24/00; A63B 24/0003; A63B 24/0021; A63B 24/0059; A63B 24/0062; A63B 24/0087; A63B 37/0003; A63B 37/0022; A63B 37/00221; A63B 37/0024; A63B 37/0027; A63B 37/0031; A63B 37/0033; A63B 37/0039; A63B 37/0043; A63B 37/0044; A63B 37/0045; A63B 37/0047; A63B 37/0051; A63B 37/0058; A63B 37/00621; A63B 37/00622; A63B 37/0063; A63B 37/0064; A63B 37/0065; A63B 37/0066; A63B 37/0074; A63B 37/0075; A63B 37/0076; A63B 37/0078; A63B 37/0091; A63B 37/0092; A63B 37/0094; A63B 37/08; A63B 37/12; A63B 43/00; A63B 43/004; A63B 43/06; A63B 45/00; A63B 45/02; A63B 47/02; A63B 47/025; A63B 47/04; A63B 53/02; A63B 53/04; A63B 53/0408; A63B 53/0433; A63B 53/0437; A63B 53/0466; A63B 53/047; A63B 53/0487; A63B 53/14; A63B 55/20; A63B 55/408; A63B 57/00; A63B 57/0006; A63B 57/20; A63B 57/203; A63B 57/207; A63B 57/353; A63B 57/50; A63B 59/20; A63B 60/00; A63B 60/06; A63B 60/08; A63B 60/10; A63B 60/14; A63B 60/46; A63B 60/54; A63B 60/56; A63B 63/00; A63B 67/02; A63B 69/0002; A63B 69/002; A63B 69/0026; A63B 69/0028; A63B 69/0053; A63B 69/0071; A63B 69/16; A63B 69/18; A63B 69/26; A63B 69/36; A63B 69/3632; A63B 69/3694; A63B 69/38; A63B 69/40; A63B 69/406; A63B 71/0036; A63B 71/022; A63B 71/06; A63B 71/0605; A63B 71/0622; A63B 71/0669; A63B 71/085; A63B 71/10; A63B 71/141; B65B 1/04; B65B 11/025; B65B 11/045; B65B 25/06; B65B 25/065; B65B 3/003; B65B 3/04; B65B 3/12; B65B 31/003; B65B 31/024; B65B 35/205; B65B 37/06; B65B 39/007; B65B 47/10; B65B 5/103; B65B 51/04; B65B 51/043; B65B 51/10; B65B 57/20; B65B 61/20; B65B 63/02; B65B 69/00; B65B 7/06; B65B 7/161; B65B 7/28; B65B 9/04; B65B 9/042; B65B 9/15; B65D 1/0215; B65D 1/0223; B65D 1/06; B65D 1/32; B65D 11/02; B65D 17/4012; B65D 2203/00; B65D 2203/12; B65D 2301/20; B65D 2401/15; B65D 25/005; B65D 25/04; B65D 25/14; B65D 25/38; B65D 25/48; B65D 2543/00092; B65D 2543/00296; B65D 2543/00537; B65D 2565/385; B65D 2571/00141; B65D 2571/0066; B65D 2571/00728; B65D 35/28; B65D 41/04; B65D 43/162; B65D 47/06; B65D 47/065; B65D 47/18; B65D 47/20; B65D 47/2018; B65D 47/2031; B65D 47/242; B65D 47/243; B65D 47/248; B65D 47/265; B65D 47/30; B65D 47/305; B65D 47/32; B65D 47/42; B65D 49/04; B65D 5/00; B65D 51/24; B65D 51/28; B65D 55/02; B65D 65/38; B65D 65/46; B65D 65/466; B65D 71/36; B65D 75/008; B65D 75/5883; B65D 77/02; B65D 77/06; B65D 77/067; B65D 81/2023; B65D 81/3211; B65D 81/325; B65D 81/3266; B65D 81/365; B65D 83/00; B65D 83/0409; B65D 83/06; B65D 83/0805; B65D 83/14; B65D 83/141; B65D 83/164; B65D 83/18; B65D 83/184; B65D 83/20; B65D 83/206; B65D 83/285; B65D 83/30; B65D 83/303; B65D 83/32; B65D 83/36; B65D 83/38; B65D 83/384; B65D 83/386; B65D 83/42; B65D 83/425; B65D 83/44; B65D 83/46; B65D 83/48; B65D 83/52; B65D 83/62; B65D 83/64; B65D 83/676; B65D 83/682; B65D 86/687; B65D 83/76; B65D 83/761; B65D 83/765; B65D 83/771; B65D 83/7711; B65D 83/7713; B65D 85/72; B65D 85/73; B65D 85/8052; B65D 85/808

USPC ... 206/0.5, 0.6, 0.7, 0.8, 0.82, 0.84, 1.5, 1.7, 206/106, 125, 137, 139, 143, 144, 145, 206/147, 15, 150, 154, 158, 159, 161, 206/162, 179, 188, 19, 197, 201, 203, 206/204, 205, 207, 209, 210, 213.1, 215, 206/216, 217, 218, 219, 220, 221, 222, 206/223, 225, 226, 228, 229, 231, 232, 206/237, 242, 246, 248, 254, 256, 265, 206/268, 270, 273, 277, 278, 279, 280, 206/292, 296, 3, 303, 304, 305, 306, 307,

206/308.1, 308.2, 308.3, 309, 310, 311, 206/315.1, 315.11, 315.2, 315.3, 315.4, 206/315.5, 315.9, 316.1, 316.2, 319, 320, 206/327, 335, 338, 349, 350, 361, 363, 206/364, 365, 366, 368, 37, 370, 371, 206/372, 373, 374, 379, 38, 385, 386, 206/387.1, 387.11, 389, 392, 395, 397, 206/398, 403, 407, 408, 409, 416, 418, 206/419, 423, 425, 426, 427, 428, 430, 206/431, 432, 434, 436, 438, 439, 440, 206/443, 445, 446, 448, 45.2, 45.21, 206/45.22, 45.24, 45.25, 45.28, 45.29, 206/45.3, 451, 453, 454, 455, 456, 457, 206/459.1, 459.5, 461, 462, 463, 467, 206/468, 469, 470, 472, 473, 480, 484, 206/485, 486, 487, 494, 497, 499, 5.1, 206/501, 502, 503, 504, 505, 506, 507, 206/508, 509, 510, 511, 512, 513, 514, 206/515, 516, 517, 518, 519, 520, 521, 206/521.1, 521.15, 521.4, 521.7, 521.8, 206/521.9, 522, 523, 524.1, 524.2, 524.3, 206/524.4, 524.6, 524.7, 524.8, 525, 526, 206/527, 528, 529, 530, 531, 532, 533, 206/534, 534.1, 535, 537, 538, 539, 540, 206/541, 542, 543, 545, 546, 547, 549, 206/550, 551, 553, 554, 557, 558, 560, 206/561, 562, 563, 564, 565, 566, 568, 206/569, 570, 571, 573, 575, 577, 579, 206/581, 583, 584, 585, 586, 589, 590, 206/591, 592, 593, 594, 597, 598, 599, 206/6.1, 600, 63.5, 69, 70, 702, 706, 707, 206/709, 710, 711, 712, 719, 722, 723, 206/725, 731, 734, 738, 743, 746, 749, 206/753, 756, 757, 762, 763, 765, 766, 206/767, 768, 77.1, 773, 775, 776, 778, 206/779, 784, 802, 803, 804, 805, 806, 206/807, 809, 811, 813, 818, 819, 820, 206/821, 822, 823, 830, 831, 95, 96; 215/10, 11.6, 12.1, 12.2, 13.1, 206, 208, 215/211, 216, 217, 220, 222, 228, 229, 215/230, 232, 235, 246, 247, 251, 252, 215/254, 256, 262, 267, 272, 277, 290, 215/293, 309, 316, 321, 330, 331, 332, 215/346, 352, 354, 356, 365, 373, 376, 215/377, 379, 381, 382, 383, 384, 386, 215/387, 391, 392, 395, 396, 398, 40, 43, 215/44, 45, 6, 900, 901, DIG. 7

See application file for complete search history.

(56) References Cited

U.S. PATENT DOCUMENTS

| | | | | |
|---|---|---|---|---|
| 3,494,503 | A * | 2/1970 | Kingsley | B65G 1/07 312/306 |
| 4,473,917 | A * | 10/1984 | Britton | A63B 47/04 15/21.2 |
| 5,040,675 | A * | 8/1991 | Cleveland | A63B 57/0032 206/315.9 |
| 6,189,732 | B1 * | 2/2001 | Althaus | A63B 47/002 221/312 R |
| 6,213,574 | B1 * | 4/2001 | Pierce | A63B 47/002 206/315.9 |
| 10,947,010 | B2 * | 3/2021 | Castelli | B65D 25/32 |
| 2004/0004097 | A1 * | 1/2004 | Seenauth | A63B 57/20 224/919 |
| 2007/0163903 | A1 * | 7/2007 | Howard | A63B 47/002 206/315.9 |
| 2008/0017644 | A1 * | 1/2008 | Wickland | G21F 5/12 250/506.1 |
| 2009/0194552 | A1 * | 8/2009 | Jeremias | A63B 47/002 221/185 |
| 2011/0309228 | A1 * | 12/2011 | Cox | B65G 1/07 248/573 |
| 2013/0020342 | A1 * | 1/2013 | Cardoso | B65D 81/3802 221/199 |
| 2022/0323831 | A1 * | 10/2022 | Cales | A63B 47/00 |

* cited by examiner

EXTENDABLE BASEBALL CARRIER

TECHNICAL FIELD OF THE INVENTION

The present invention relates generally to sports equipment, and more particularly to a telescoping and collapsible container for storing, carrying, and automatically supplying baseballs.

BACKGROUND OF THE INVENTION

All baseball participants use some type of container as a necessity for storing, transporting and accessing balls. This typically involves filling a bucket or like container with baseballs, carrying the ball-laden bucket around, and repeatedly bending over to retrieve a ball from the bucket to pitch or throw during batting and/or fielding practice. Such repetitious activity, while individually not especially strenuous, can add up and inflict very real pain and soreness on the participant.

Various devices have been developed to address these issues.

Perhaps the most common such devices are the ball caddy and the bucket stand. Ball caddies and bucket stands are simply an assembly of elongated metal legs, typically joined together at their midpoints, that provide a support structure from which a bucket, basket or bag is suspended at the top end for access to the balls filling the same. While helpful, ball caddies and bucket stands still suffer from the drawbacks of the elongated legs being awkward and cumbersome for transport and setup, and the container of balls when being depleted still requires bending and stretching to retrieve bottom balls. Thus, there remains a need for an improved method and device for carrying baseballs as well as for easy retrieval of the same. The present invention addresses this need.

DETAILED DESCRIPTION OF THE PREFERRED EMBODIMENTS

Figure 1:
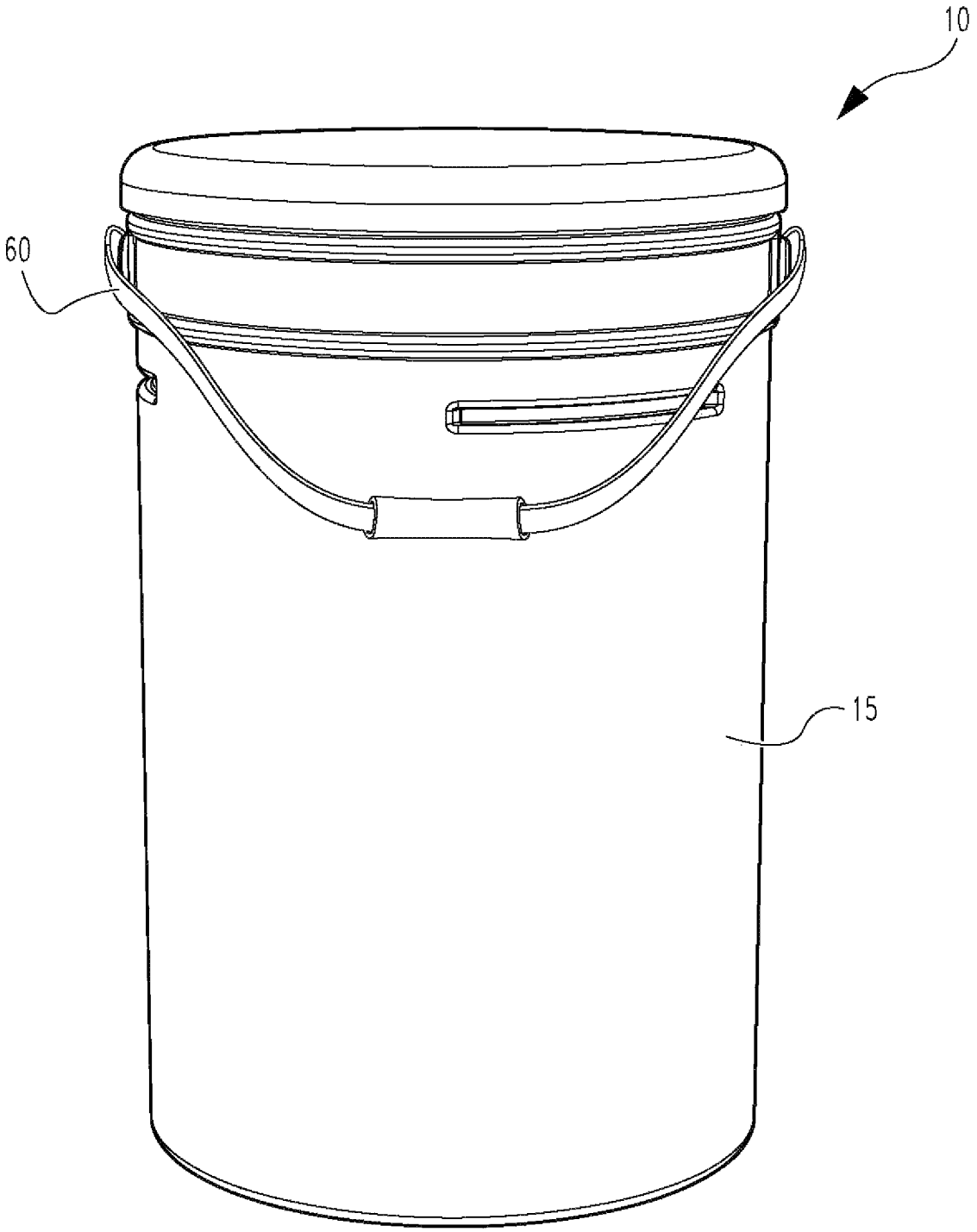
FIG. 1 is a first front elevation view of a first embodiment extendable baseball carrier of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
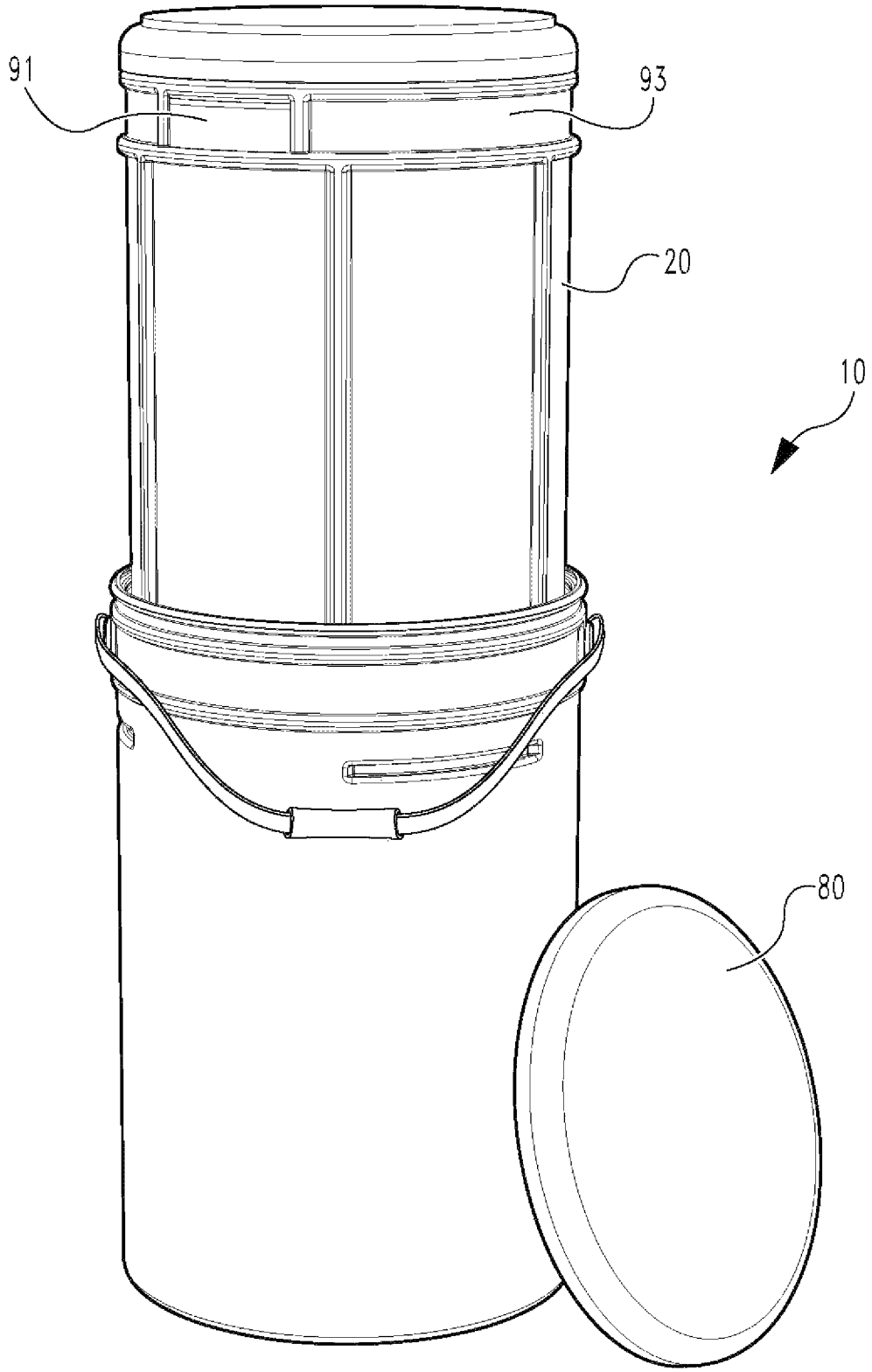
FIG. 2 is a second front elevation view of a first embodiment extendable baseball carrier of the embodiment of FIG. 1 and with the inner container extended and locked.
Figure 3:
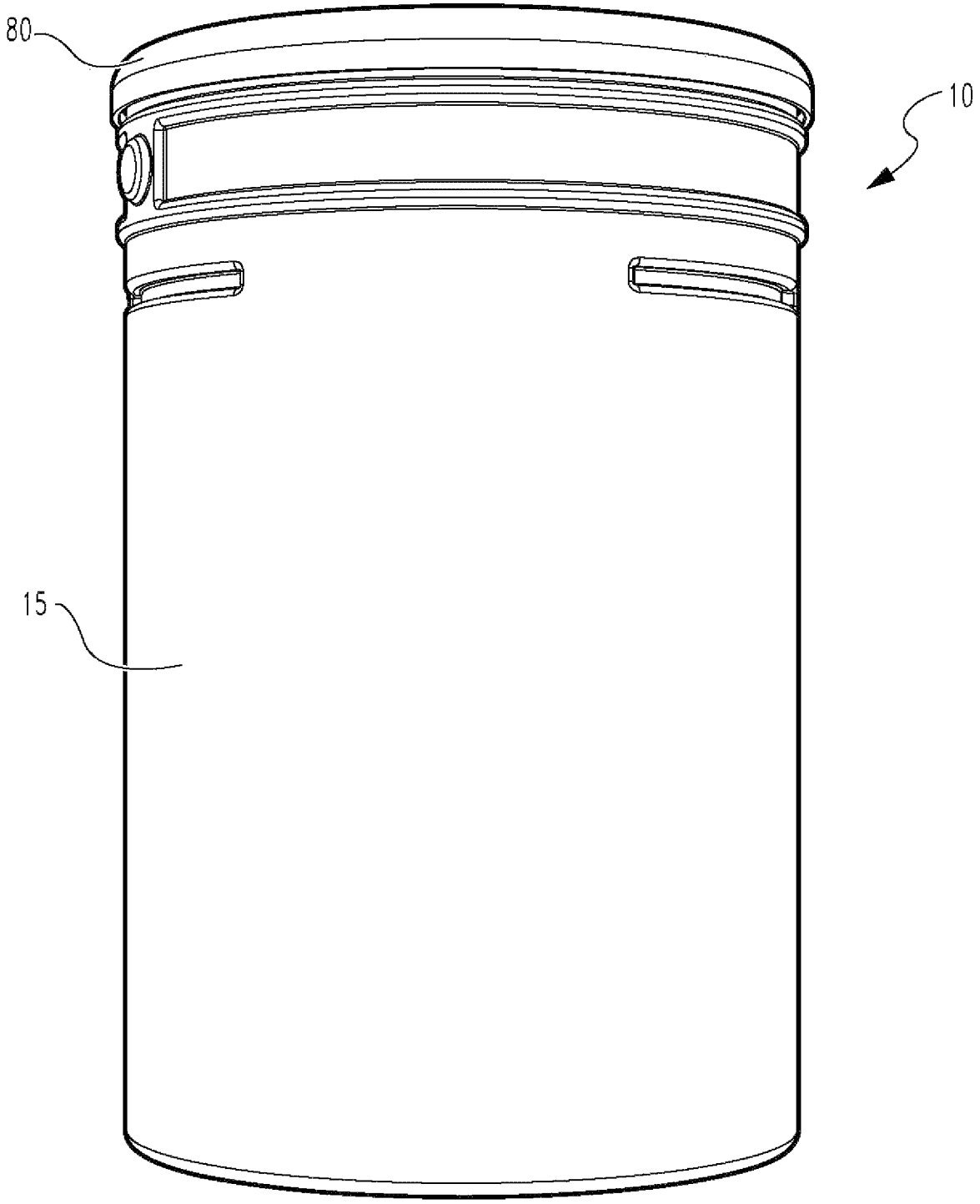
FIG. 3 is side elevation view of the embodiment of FIG. 1.
Figure 4:
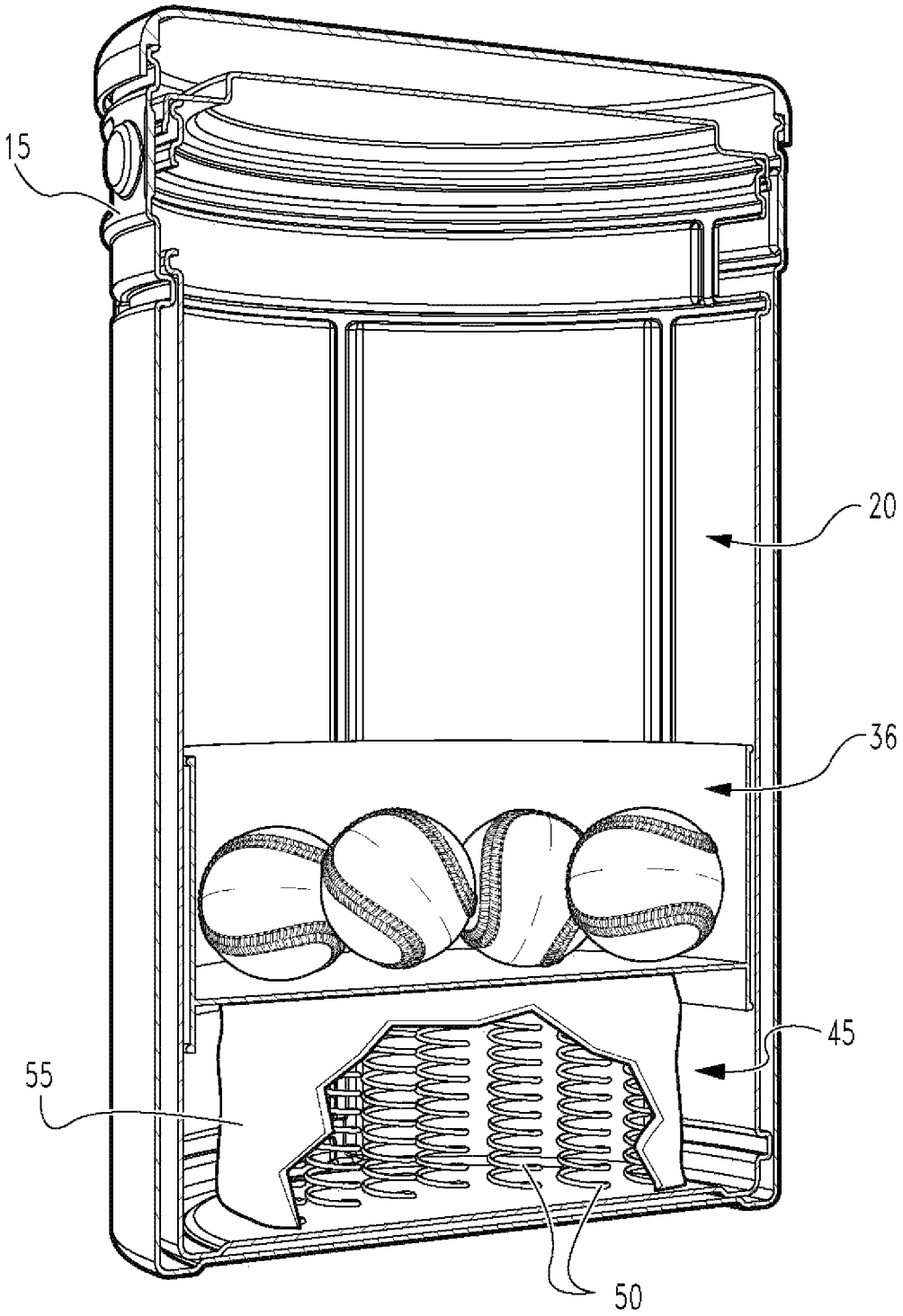
FIG. 4 is a partial side cutaway elevation view of the embodiment of FIG. 3.
Figure 5:
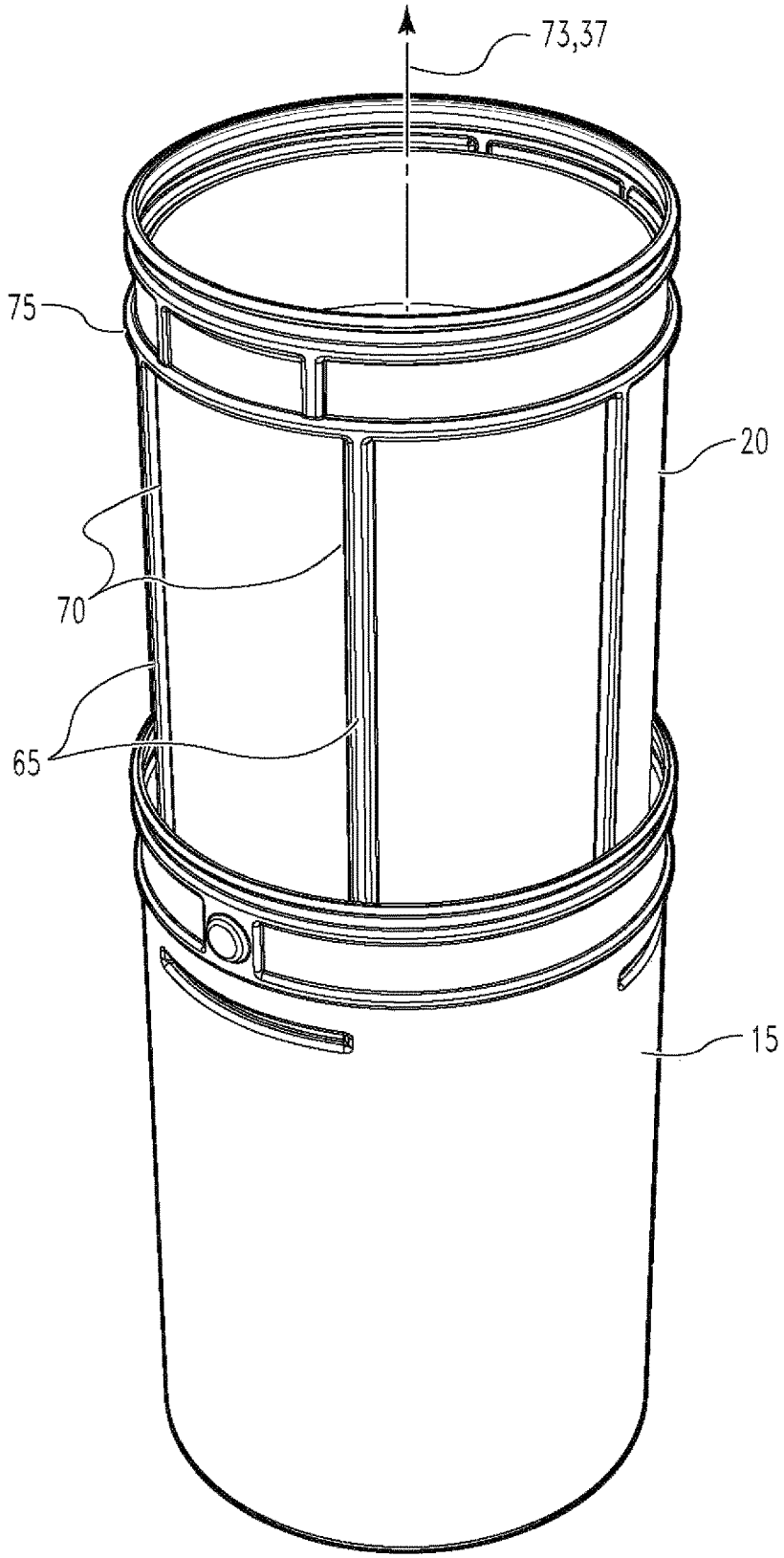
FIG. 5 is a perspective view of the embodiment of FIG. 2.
Figure 6:
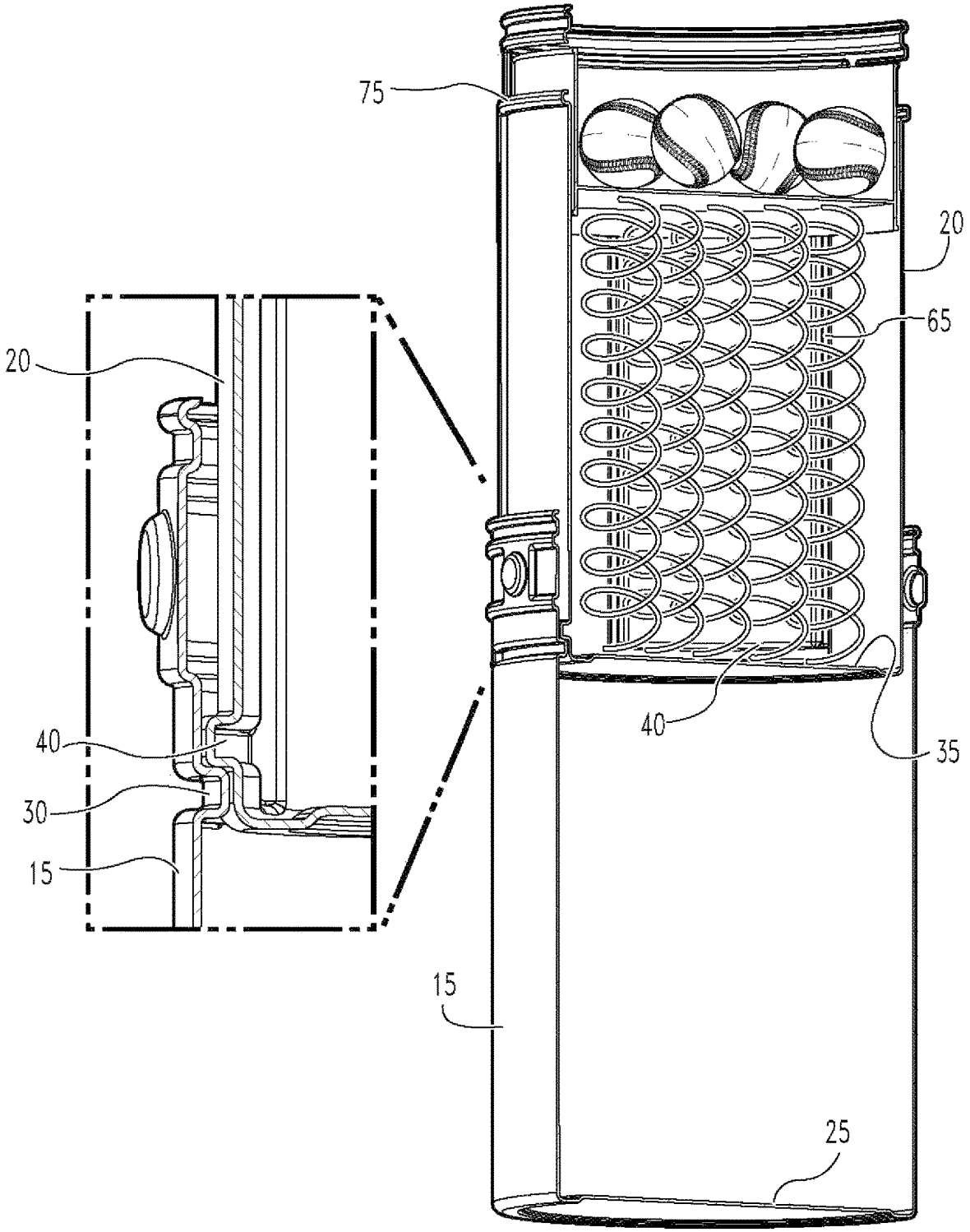
FIG. 6 is a partial cutaway view of the embodiment of FIG. 5.
Figure 7:
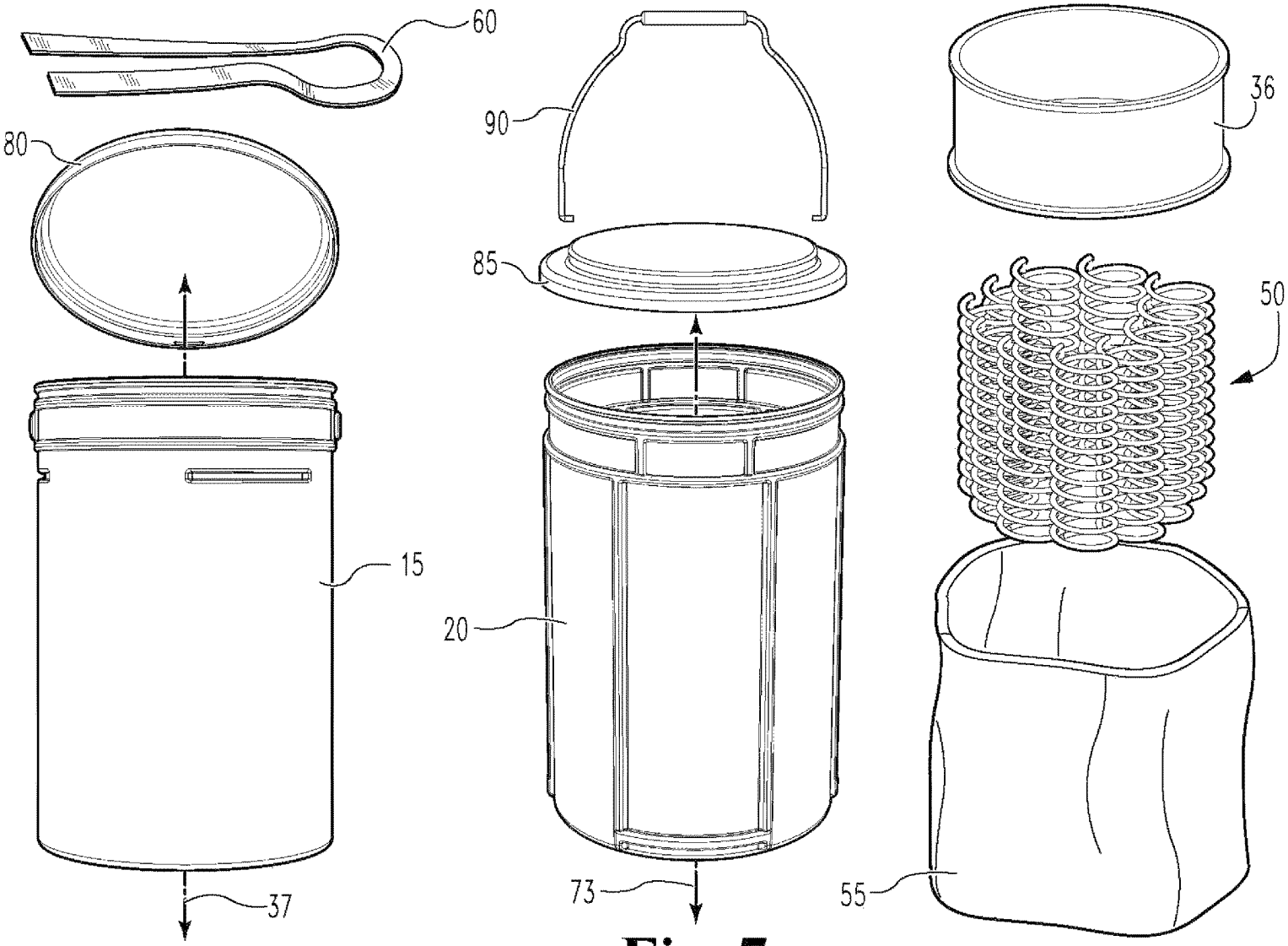
FIG. 7 is an exploded view of the embodiment of FIG. 1.

FIGS. 1-7 relate to a first embodiment of the present invention, an extendable baseball carrier assembly 10 having a first outer right circular cylindrical portion (also called member) 15 and a second inner right circular cylindrical portion 20 (also called member) defining a storage volume and operationally connected to and disposed within the first portion 15. The first right circular cylindrical portion 15 further includes a circular bottom portion (also called member) 25 disposed at one end to define a cannister, and at least one elongated shelf or ledge portion (also called member) 30 disposed near the opposite end of the first right circular cylindrical portion 15 and extending inwardly therefrom. Typically, the at least one shelf member 30 is three equidistantly disposed shelf members 30.

The second right circular cylindrical portion 20 likewise includes a circular bottom portion (also called member) 35 disposed therein as well as at least one tab portion (also called member) 40, typically disposed near the bottom portion 35 of the second right circular cylindrical portion 20 and extending outwardly therefrom. More typically the at least one tab member 40 is three equidistantly disposed tab members 40. The tab and shelf members 40, 30 may be lockingly engaged together, such as by a quick twist of the cylindrical portions 15, 20 relative to one another to nearly instantaneously provide bucket stand functionality.

Second right circular cylindrical portion 20 further includes a floating platform member 36 positioned therein, which may move within second right circular cylindrical portion 20 along cylindrical axis 37. In other words, platform member 36 'floats' within the second right circular cylindrical portion 20. The platform member 36 is typically replaceably removable from within the second right circular cylindrical portion 20.

A spring assembly 45 is disposed between bottom member 35 and platform member 36. Spring assembly includes one or more springs 50. Springs 50 are typically, although not necessarily, disposed within a flexible bag 55. Spring assembly 45 is typically replaceably removable from within the second right circular cylindrical portion 20.

In some embodiments, assembly 10 includes a flexible strap or handle member 60 removably connectable to first right circular cylindrical portion 15.

The second right circular cylindrical portion 20 is typically fully removable from the first right circular cylindrical portion 15 to yield a second, independent ball storage vessel. The second right circular cylindrical portion 20 is also typically fully insertable into the first right circular cylindrical portion 15 to yield a fully nestable assembly 10. The second right cylindrical portion 20 further includes at least one, and typically a plurality of equidistantly positioned raised elongated members (also called ridges or tongues) 65 formed on either side of second right cylindrical portion 20, while defining at least one, and more typically a plurality of equidistantly spaced, elongated recesses (also called rails, channels, or grooves) 70 therebetween. The elongated grooves 70 are sized to loosely accommodate movement of respective tab members 40 therethrough (in a fit looser than an interference fit) such that the second right circular cylinder 20 may be easily moved into and out of the first right circular cylinder 15 but once inserted may be constrained from rotation about its major axis 73. The elongated ridges and grooves 65, 70 function as vents to allow passage of air therethrough when the platform 36 is moved within second right circular cylinder 20 as well as when second right circular cylinder 20 is moved within first right circular cylinder 15. Once second right circular cylinder 20 is inserted and/or nested within first right circular cylinder 15, major axes 37, 73 are colinear.

Respective circular lid members 80, 85 are typically provided to snugly engage respective right circular cylinder members 15, 20, such as with interference fits, snap fits, or the like. Lid members 80, 85 may be contoured to provide comfortable seating.

A handle member 90 is typically provided to lockingly engage second right circular cylinder member 20 for ease of transport. In some embodiments, handle member 90 is removably attachable to lid member 85, which is in turn removably attachable to right circular cylinder member 20. In other embodiments, handle 91 is at least one, and more typically two oppositely disposed, apertures or cut-outs 91 formed through sidewall 93 of right circular cylinder 20.

In operation, the assembly 10 is at least partially filled with baseballs or the like. The assembly 10 is in a first, transport mode when the second cylindrical portion 20 is disposed within the first cylindrical portion 15. When a ball supply is required, second cylindrical portion 20 is partially extracted from within first cylindrical portion 15, and partially rotated therein to lockingly engage tab(s) 40 with ledge(s) 30 to engage second bucket stand mode.

Spring assembly 45 has a spring constant such that it provides sufficient urging force against platform member 36 to keep the baseballs near the top of the second cylindrical portion 20. As balls are removed from the container 20 platform member 36 is urged away from bottom member 35, typically against the pull of gravity, raising the remaining balls and keeping the ball supply within easy reach of the top of the assembly 10.

The second cylindrical portion 20 may be completely extracted and removed from the assembly 10 so as to more easily fill the first and/or second cylindrical portions 15, 20 with balls.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A baseball carrying assembly, comprising in combination:

a first right circular cylindrical member defining a first sidewall;

a first circular member disposed at one end of the first right circular cylindrical member and operationally connected thereto;

a second right circular cylindrical member defining a second sidewall and defining a storage volume and fully nestable within the first right circular cylindrical member and operationally connectable thereto;

a second circular member disposed at one end of the second right circular cylindrical member and operationally connected thereto;

a platform member movably disposed within the second right circular cylindrical member and a spring assembly operationally connected between the second circular member and the platform member:

wherein the spring assembly has a spring constant sufficient to urge the platform member away from the second circular member when stored items are removed from the storage volume.

2. The assembly of claim 1 and further comprising a flexible member removably attachable to the first right circular cylindrical member and a handle member removably attachable to the second right circular cylindrical member.

3. The assembly of claim 1 and further comprising a flexible bag encasing the spring assembly.

4. The assembly of claim 1 and further comprising first and second lid members sized to operationally connect to respective first and second right circular cylindrical members opposite the respective right circular cylindrical member operationally connected thereto, wherein each respective lid member is connectable to a respective sidewall, and wherein each respective lid member is contoured to provide a seat.

5. The assembly of claim 1 and further comprising a handle member operationally connectable to the second lid member for extracting the second right circular cylinder from within the first right circular cylinder.

6. The assembly of claim 1 and further comprising:

at least one ledge member formed within the first right circular cylindrical member; and at least one tab member protruding from the second right circular cylindrical member;

wherein the at least one tab member and the at least one ledge member are lockingly engageable.

7. The assembly of claim 1 and further comprising:

three equidistantly spaced ledge members formed within the first right circular cylindrical member; and three equidistantly spaced tab members protruding from the second right circular cylindrical member;

wherein each respective tab member is lockingly engageable with a respective ledge member.

8. The assembly of claim 1 and further comprising:

four equidistantly spaced ledge members formed within the first right circular cylindrical member; and four equidistantly spaced tab members protruding from the second right circular cylindrical member;

wherein each respective tab member is lockingly engageable with a respective ledge member.

9. The assembly of claim 1 wherein the second sidewall has at least one handle aperture formed therethrough.

10. A ball carrying assembly, comprising in combination:

a first right circular cylindrical portion defining a first major axis;

a first disc portion disposed at one end of the first right circular cylindrical portion and fixed thereto to define a first canister;

a second right circular cylindrical portion defining a second major axis and defining a storage volume and disposable within the first right circular cylindrical portion and operationally connectable thereto;

a second disc portion disposed at one end of the second right circular cylindrical portion and fixed thereto to define a second canister;

a platform portion movably disposed within the second right circular cylindrical member;

a plurality of respective equidistantly spaced ledge portions formed within the first right circular cylindrical portion; and a plurality of respective equidistantly spaced tab portions protruding from the second right circular cylindrical portion;

wherein each respective tab portion is lockingly engageable with a respective ledge portion;

a spring assembly operationally connected between the second disc portion and the platform portions; and wherein the spring assembly has a spring constant sufficient to urge the second disc portion away from the first disc portion when balls are removed from the storage volume.

11. The ball carrying assembly of claim 10 and further comprising three equidistantly spaced vent grooves formed on the second right circular cylindrical portion parallel to the second major axis; wherein each respective vent groove is sized to accept a respective ledge portion.

12. A method of providing balls to a ballplayer, comprising:

a) at least partially filling a first right circular cylindrical container with balls, wherein first right circular cylindrical container has an open end and an oppositely disposed closed end, and wherein a spring loaded platform is operationally connected within the right circular cylindrical container;

b) disposing the first right circular cylindrical container within a second right circular cylinder, wherein the second right circular cylinder has a greater diameter than does the first right circular cylindrical container;

c) partially extracting the first right circular cylindrical container from the second right circular cylinder;

d) lockingly engaging the first right circular cylindrical container and second right circular cylinder; and e) applying an urging force to the spring loaded platform to urge the balls against gravity.

13. The method of claim 12 wherein the spring loaded platform enjoys a spring constant sufficient to position the balls adjacent the open end.

14. The method of claim 12 and further comprising:

f) removing the first right circular cylindrical container from the second right circular cylinder;

g) refilling the first right circular cylindrical container with balls; and h) reengaging the first right circular cylindrical container and the second right circular cylinder.

* * * * *